US010668331B2

(12) United States Patent
Bibby

(10) Patent No.: US 10,668,331 B2
(45) Date of Patent: Jun. 2, 2020

(54) BALL WITH ANOMALIES

(76) Inventor: Charlie Henry Bibby, Memphis, TN (US)

( * ) Notice: Subject to any disclaimer, the term of this patent is extended or adjusted under 35 U.S.C. 154(b) by 632 days.

(21) Appl. No.: 12/716,576

(22) Filed: Mar. 3, 2010

(65) Prior Publication Data

US 2011/0218064 A1 Sep. 8, 2011

(51) Int. Cl.
*A63B 43/00* (2006.01)
*A63B 41/02* (2006.01)
*A63B 43/04* (2006.01)

(52) U.S. Cl.
CPC ..... *A63B 41/02* (2013.01); *A63B 43/00* (2013.01); *A63B 43/04* (2013.01)

(58) Field of Classification Search
CPC ..... A63B 41/02; A63B 43/00; A63B 43/04
USPC ..... 473/595, 614; D21/204, 713
See application file for complete search history.

(56) References Cited

U.S. PATENT DOCUMENTS

| | | | | | |
|---|---|---|---|---|---|
| 744,718 | A * | 11/1903 | cassidy | 601/131 | |
| 2,129,238 | A * | 9/1938 | Riddell | 156/147 | |
| 2,859,040 | A * | 11/1958 | Gow | A63B 41/08 | 473/596 |
| 3,968,967 | A * | 7/1976 | Nally | 473/423 | |
| 4,003,573 | A | 1/1977 | Craig, Jr. | | |
| 4,187,134 | A * | 2/1980 | Svub et al. | 156/170 | |
| 4,570,931 | A * | 2/1986 | Martin | 473/596 | |
| 5,028,053 | A | 7/1991 | Leopold | | |
| 5,133,550 | A * | 7/1992 | Handy | A63B 37/14 | 473/596 |
| 5,297,981 | A | 3/1994 | Maxim et al. | | |
| 5,851,161 | A * | 12/1998 | Sassak | 473/596 | |
| 6,099,423 | A * | 8/2000 | Ou | 473/604 | |
| 6,348,018 | B1 * | 2/2002 | Ou | 473/599 | |
| 7,413,524 | B1 | 8/2008 | Bibby | | |
| 2002/0077202 | A1 | 6/2002 | Guenther et al. | | |
| 2002/0137582 | A1 | 9/2002 | Yu | | |
| 2004/0006294 | A1 | 1/2004 | Zemont | | |

(Continued)

FOREIGN PATENT DOCUMENTS

| | | | |
|---|---|---|---|
| CN | 2436181 | Y | 6/2001 |
| CN | 201175550 | Y | 1/2009 |
| DE | 4339831 | A1 | 3/1995 |

OTHER PUBLICATIONS

China Office Action dated Apr. 1, 2014 for China Patent Application No. 201180011953.2, filed Sep. 3, 2012.

(Continued)

*Primary Examiner* — Vishu K Mendiratta
(74) *Attorney, Agent, or Firm* — Innovation Capital Law Group, LLP; Vic Lin

(57) ABSTRACT

A bouncy ball includes anomalies which, when bounced upon, causes the ball to bounce irregularly. The anomaly may comprise a solid protrusion formed integrally with an outer skin of the ball or a separate plug filled into a pocket formed in the outer skin. The shape of the protrusion may be partially spherical. The solid protrusion may also include elongate grooves, flat surfaces or any other desired shape, such as a star. The bouncy ball may also include a secondary bladder with inflatable anomalies. The secondary bladder is coupled to a generally spherical inner tube which may be formed with grooves to receive the secondary bladder. Outer skins may be coupled over the secondary bladder and inner tube.

6 Claims, 10 Drawing Sheets

(56) References Cited

U.S. PATENT DOCUMENTS

| | | | | |
|---|---|---|---|---|
| 2006/0063623 | A1* | 3/2006 | Zheng | 473/614 |
| 2007/0015615 | A1* | 1/2007 | Yang | 473/614 |
| 2008/0108462 | A1* | 5/2008 | Krysiak | A63B 41/08 473/603 |
| 2008/0305900 | A1* | 12/2008 | Geisendorfer | 473/596 |
| 2011/0207564 | A1* | 8/2011 | Goodall et al. | 473/595 |

OTHER PUBLICATIONS

China Search Report dated Apr. 1, 2014 for China Patent Application No. 201180011953.2, filed Sep. 3, 2012.

Notification of Transmittal of the International Search Report and the Written Opinion of the International Searching Authority for International Patent Application No. PCT/US2011/026801 (dated Apr. 12, 2011).

* cited by examiner

BALL WITH ANOMALIES

BACKGROUND OF THE INVENTION

1. Field of the Invention

The present invention relates generally to balls for sports and recreation.

2. Description of Prior Art and Related Information

In sports, balls are generally spherical and are thus predictable in the manner in which they bounce and react to force. It may be desirable to form a ball with protrusions so as to create an erratic bounce. Such erratic bouncing may be desirable in improving a user's motor skills or providing fun and enjoyment.

SUMMARY OF THE INVENTION

The present invention provides structures and methods which overcome the deficiencies in the prior art.

In one aspect, a bouncy ball is provided. The ball comprises an inflatable bladder having an inner surface and an outer surface. A skin is configured to be coupled to the outer surface of the inflatable bladder. The ball further comprises a solid anomaly which, when bounced upon, causes the ball to bounce erratically.

The skin comprises a first rubber material and a pocket having a pocket inner surface. In one embodiment, the solid anomaly may comprise a separate plug composed of a second rubber material different from the first rubber material. The plug is configured to fit into the pocket between the outer surface of the bladder and the pocket inner surface so as to form a protrusion.

In another embodiment, the ball the solid anomaly is integral with the skin and composed of a same rubber material as the skin.

The solid anomaly may comprise a protrusion which may be at least partially spherical. The protrusion may comprise elongate grooves. The solid anomaly may comprise a plurality of flat surfaces formed on the outer surface of the skin.

In another aspect, a bouncy ball comprises an inflatable bladder having an inner surface and an outer surface. A skin is configured to be coupled to the outer surface of the inflatable bladder. The ball further comprises a solid protrusion which, when bounced upon, causes the ball to bounce erratically.

In one embodiment, the skin may comprise a first rubber material and a pocket having a pocket inner surface. The solid protrusion may comprise a plug composed of a second rubber material different from the first rubber material. The plug is configured to fit into the pocket between the outer surface of the bladder and the pocket inner surface.

In another embodiment, the solid anomaly is integral with the skin and composed of a same rubber material as the skin.

The protrusion may be at least partially spherical. The protrusion may comprise elongate grooves. The solid anomaly may comprise a plurality of flat surfaces formed on the outer surface of the skin.

In a further aspect, a bouncy ball comprises a first, inner inflatable bladder having a first inner surface and a first outer surface. A second inflatable bladder is configured to be coupled to the first outer surface of the first inflatable bladder. The second inflatable bladder comprises an anomaly which, when bounced upon, causes the ball to bounce erratically. An outer skin is configured to wrap around the first inflatable bladder and the second inflatable bladder.

The second inflatable bladder comprises an air chamber. The anomaly comprises an air pocket in fluid communication with the air chamber, the air pocket being configured to form a protrusion when inflated. The skin comprises a skin pocket configured to receive the protrusion of the second inflatable bladder. The second inflatable bladder comprises a generally thin and elongate band. The first inflatable bladder comprises a groove to receive the band of the second inflatable bladder. The second inflatable bladder comprises a pair of generally thin and elongate bands formed in a crisscross pattern.

In a further aspect, a bouncy ball includes anomalies which, when bounced upon, causes the ball to bounce irregularly. The anomaly may comprise a solid protrusion formed integrally with an outer skin of the ball or a separate plug filled into a pocket formed in the outer skin. The shape of the protrusion may be partially spherical. The solid protrusion may also include elongate grooves, flat surfaces or any other desired shape, such as a star. The bouncy ball may also include a secondary bladder with hollow inflatable anomalies. The secondary bladder is coupled to a generally spherical inner tube which may be formed with grooves to receive the secondary bladder. Outer skins may be coupled over the secondary bladder and inner tube.

The invention, now having been briefly summarized, may be better appreciated by the following detailed description.

DETAILED DESCRIPTION OF THE PREFERRED EMBODIMENTS

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

Figure 1:
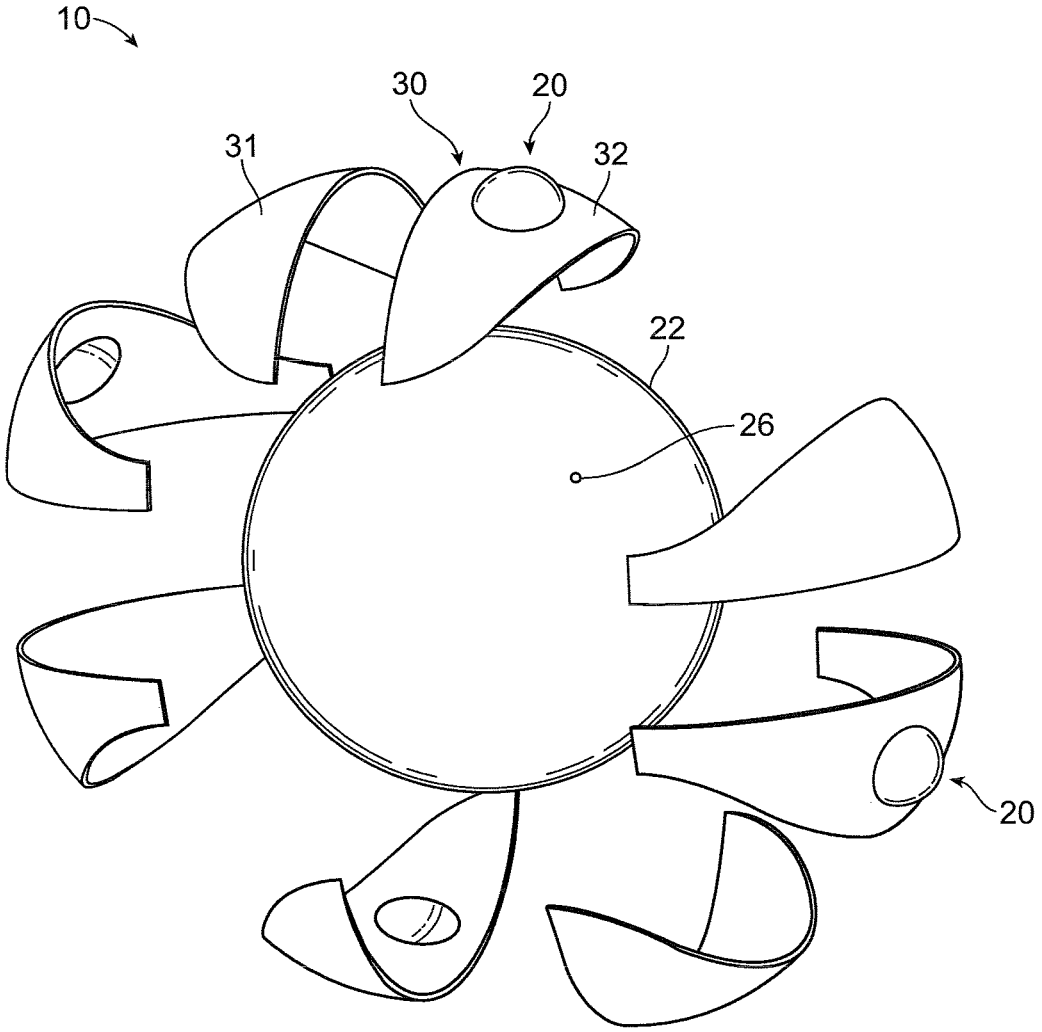
FIG. 1 is an exploded view a first preferred embodiment of a ball.

FIG. 1 is an exploded view of a first preferred embodiment of a bouncy ball 10 having one or more anomalies 20 which, when bounced upon, cause the ball 10 to bounce erratically. In the illustrated embodiments, a basketball is shown. However, it is to be expressly understood that the ball 10 may be configured for any sport or recreational purpose where any bouncing is involved.

Each anomaly 20 causes the ball 10 to bounce irregularly and react differently than if the ball were generally spherical without such anomaly. In FIG. 1, the ball 10 comprises an inner tube 22, or bladder, which is generally spherical in the preferred embodiment. The inner tube 22 comprises an outer surface 24 and inflation hole 26.

Figure 2:
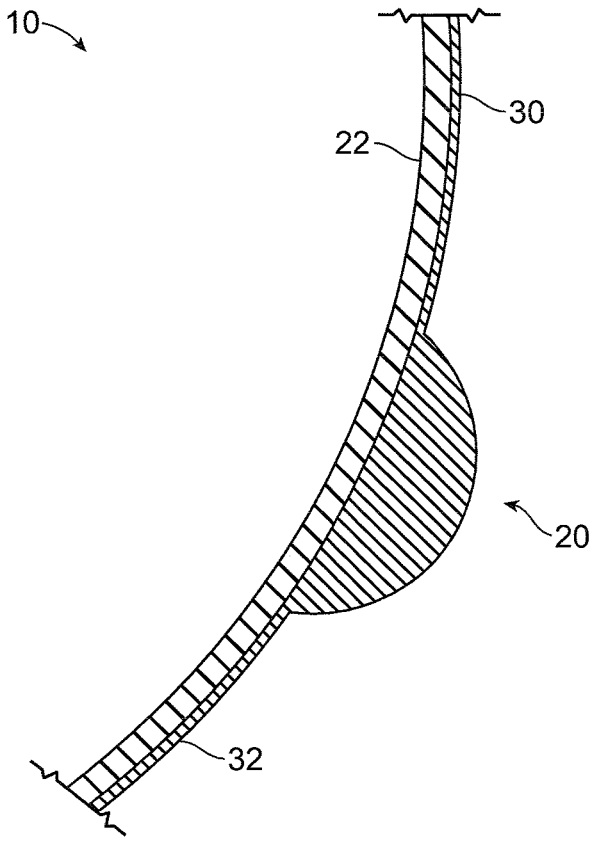
FIG. 2 is a cross-sectional view of the first preferred embodiment.

The first preferred embodiment 10 comprises a plurality of skins 30, 31 configured to be coupled to the outer surface 24 of the inner tube 22. In the first preferred embodiment, a solid anomaly 20 is integral with certain skins 30 and formed of the same material, e.g., rubber, as shown in FIG. 2. Conventional skins 31 without anomalies may be provided in an alternating arrangement or in any other desired arrangement. In the first preferred embodiment, the solid anomaly 20 is at least partially spherical and protrudes outwardly from an outer surface 32 of the skin 30. As an example and not by way of limitation, the solid anomaly 20 may be molded into the skin 30.

Figure 3:
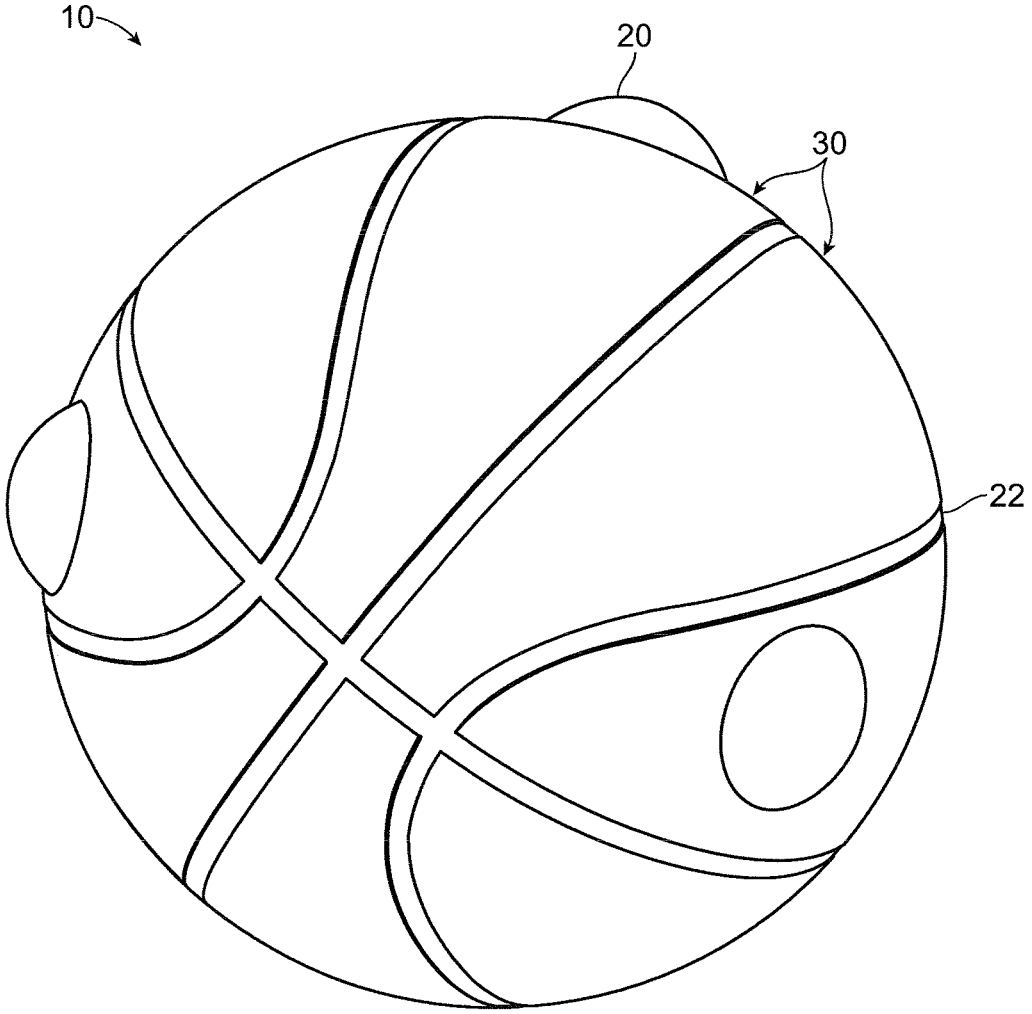
FIG. 3 is a perspective view of the first preferred embodiment, fifth preferred embodiment and sixth preferred embodiment.

FIG. 3 is a perspective view of the first preferred embodiment of the ball 10 as assembled. In FIG. 3, the skins 30 with solid anomalies 20 are coupled to the outer surface of the inner tube 22, the end result is a ball 10 including a number of solid protrusions which, when bounced upon, will cause the ball 10 to bounce and/or respond irregularly.

Since other preferred embodiments appear the same from the outside, FIG. 3 also illustrates the fifth preferred embodiment and sixth preferred embodiment, when assembled, as discussed further below.

Figure 4:
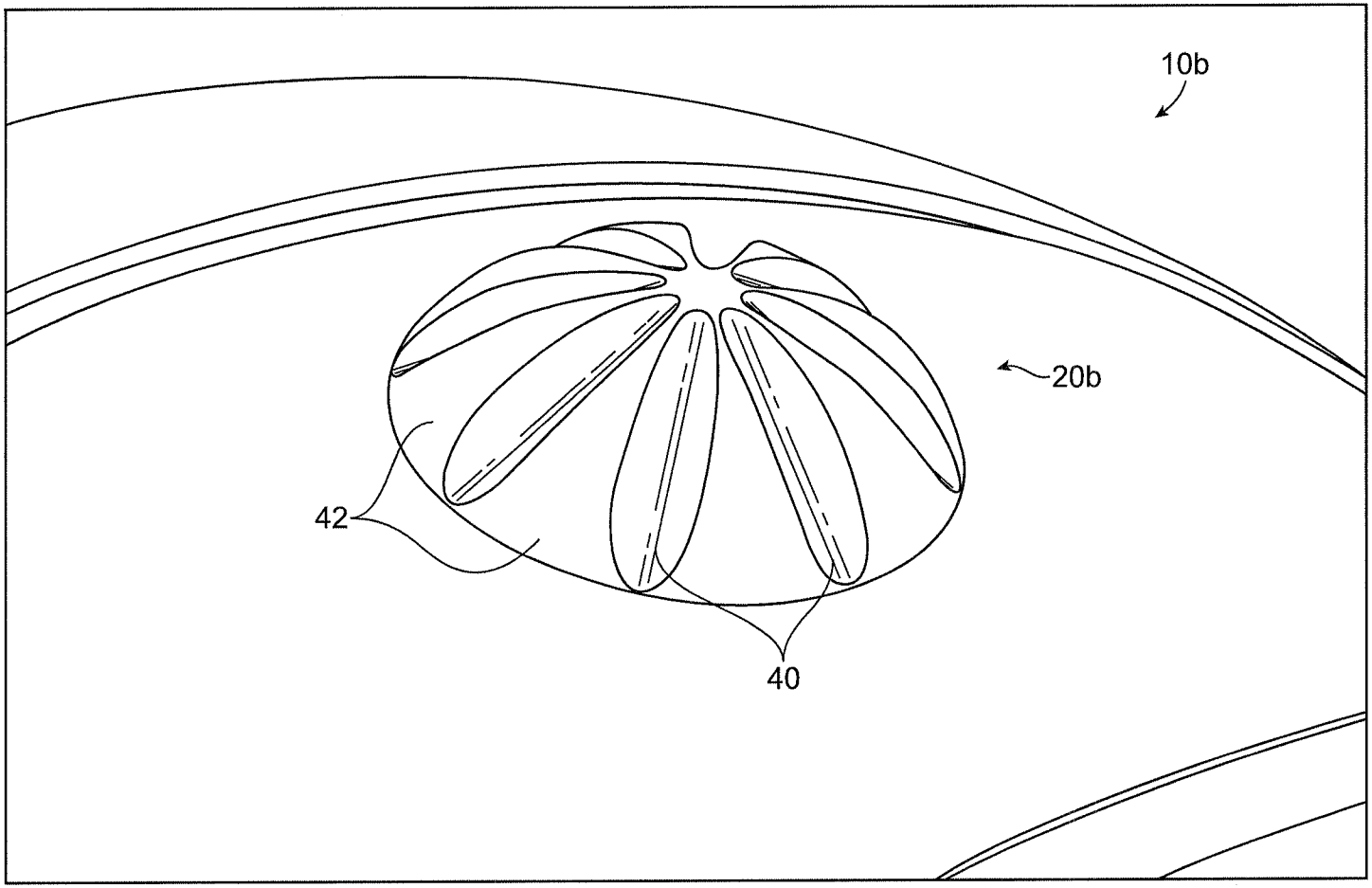
FIG. 4 is a perspective view of a second preferred embodiment of a ball having solid anomalies.

The solid anomalies placed on the outer surface of the ball may be manufactured in any desired shape to provide a certain erratic bounce, or simply to provide fun and entertainment value. FIG. 4 is a perspective view of a second preferred embodiment of a bouncy ball 10*b* where elements of similar structure are designated by the same reference numerals followed by the lower case "b." In FIG. 4, the ball 10*b* includes a plurality of solid anomalies 20*b*, each anomaly 20*b* comprising a protrusion having alternating elongate grooves 40 and elongate ribs 42.

Figure 5:
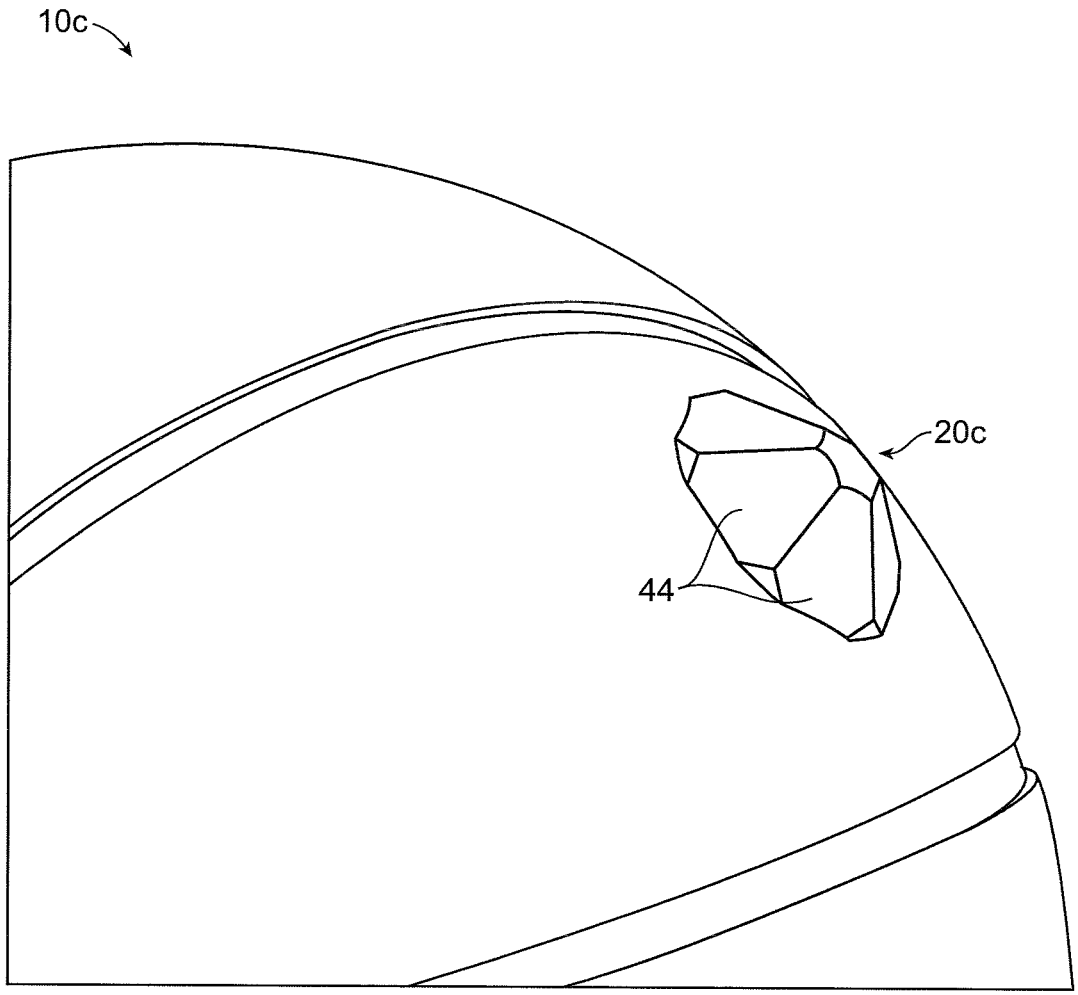
FIG. 5 is a perspective view of a third preferred embodiment of a ball having solid anomalies.

FIG. 5 is a perspective view of a third preferred embodiment of a bouncy ball 10*c* where elements of similar structure are designated by the same reference numerals followed by the lower case "c." In FIG. 5, the ball 10*c* comprises a plurality of solid anomalies 20*c*, each anomaly 20*c* comprising a protrusion formed as adjacent flat surfaces 44.

Figure 6:
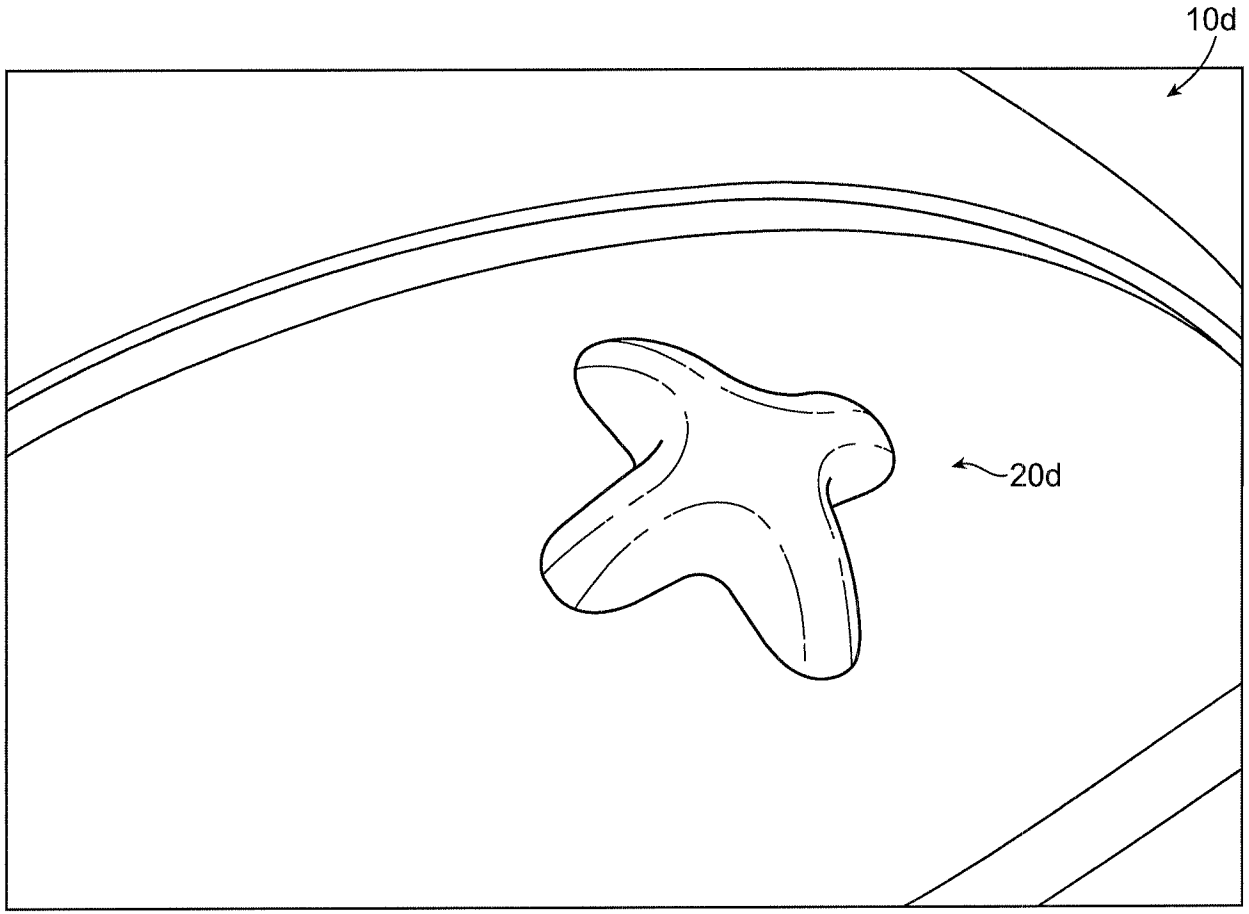
FIG. 6 is a perspective view of a fourth preferred embodiment of a ball having solid anomalies.

FIG. 6 is a perspective view of a fourth preferred embodiment of a bouncy ball 10*d* where elements of similar structure are designated by the same reference numerals followed by the lower case "d." In FIG. 6, the ball 10*d* comprises a plurality of solid anomalies 20*d*, each anomaly 20*d* comprising a protrusion shaped as a star, or cross, in the illustrated embodiment.

Figure 7:
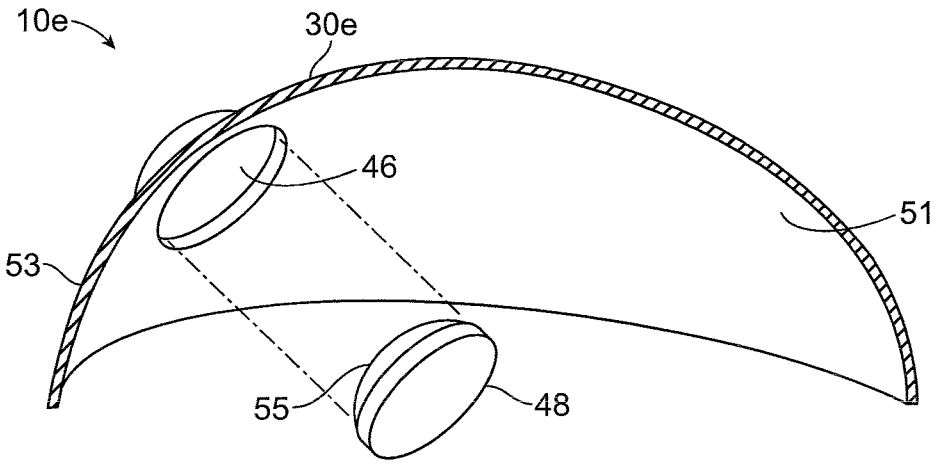
FIG. 7 is an exploded view of a fifth preferred embodiment of a ball having a solid plug, or insert.
Figure 8:
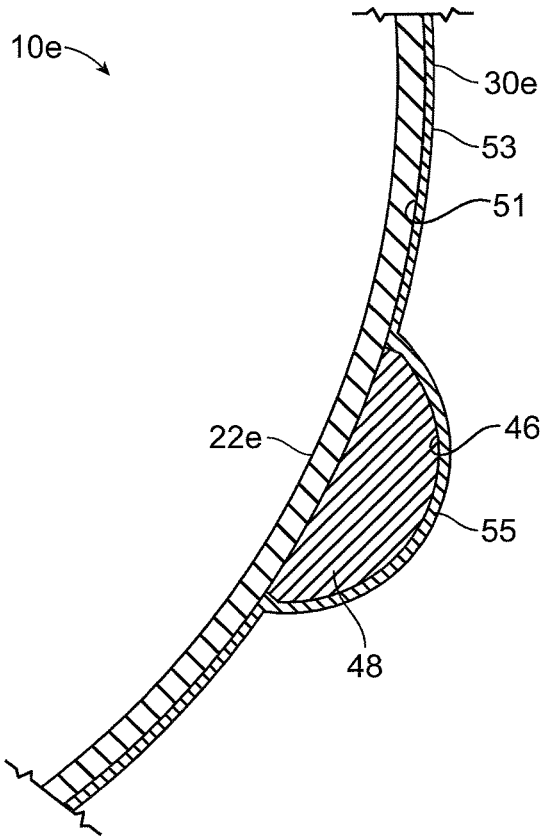
FIG. 8 is a cross-sectional view of the fifth preferred embodiment of a ball.

FIGS. 7 and 8 illustrate a fifth preferred embodiment of a bouncy ball 10*e* where elements of similar structure are designated by the same reference numerals followed by the lower case "e." In FIG. 7, the solid anomaly 20*e* comprises a pocket 46 formed in an outer skin 30*e* and a solid plug, or insert, 48 configured to fit into the pocket 46. The pocket 46 is formed on an inner surface 51 of the skin 30*e* and configured to receive the plug 48 so as to form an outward protrusion, namely, a bump that protrudes from an outer surface 53 of the skin 30*e*, as shown in FIG. 8. In this preferred embodiment, the skin 30*e* is composed of a first material while the plug 48 is composed of a second material different from the first material. The plug 48 comprises a protuberance 55 that conforms to the correspondingly shaped pocket 46. In FIG. 8, the skin 30*e* and the separate plug 48 filling the pocket 46 are coupled to the outer surface of an inner tube 22*e*.

Figure 9:
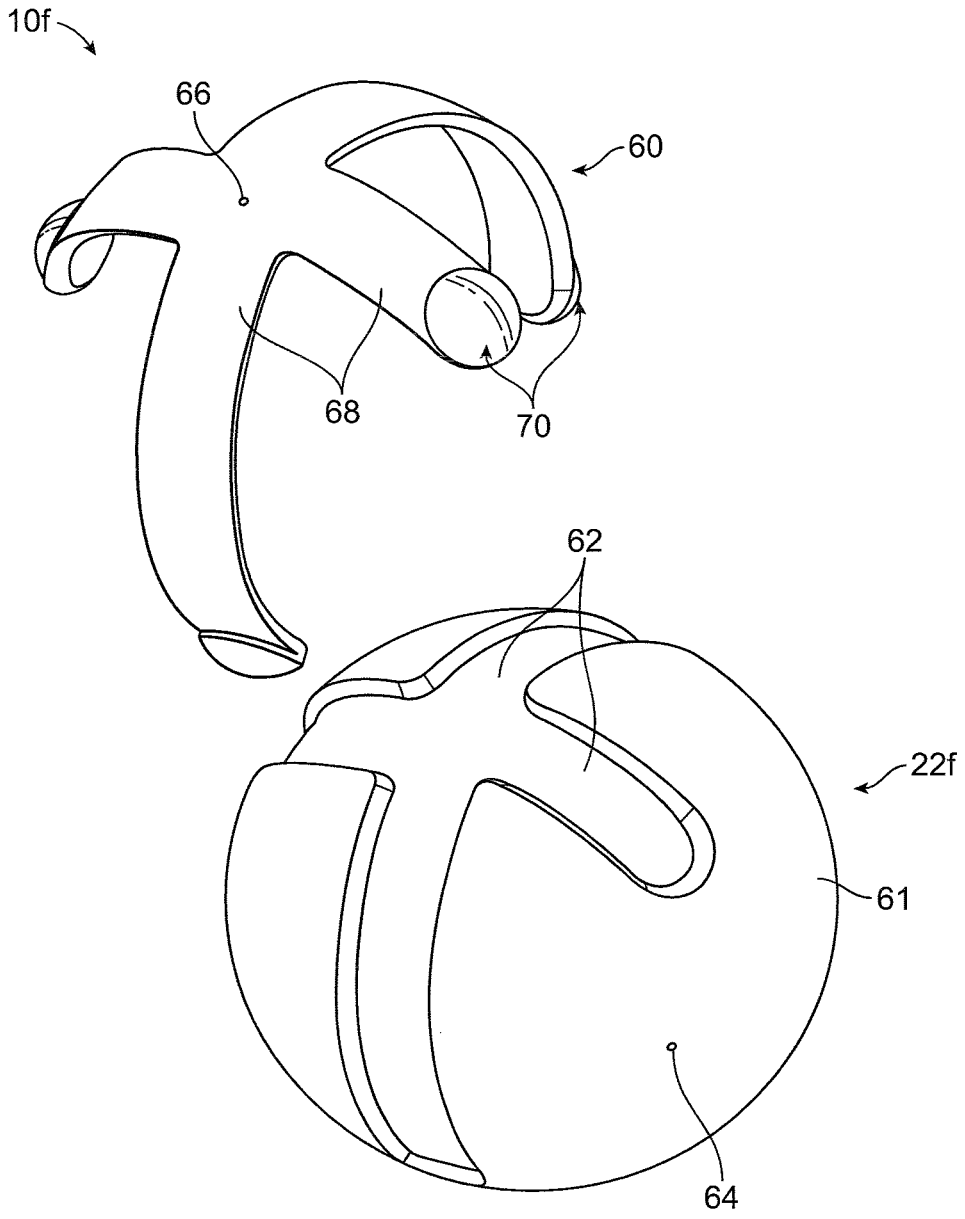
FIG. 9 is an exploded view of a sixth preferred embodiment of a ball having a second inflatable bladder with an outer skin removed for clarity.
Figure 10:
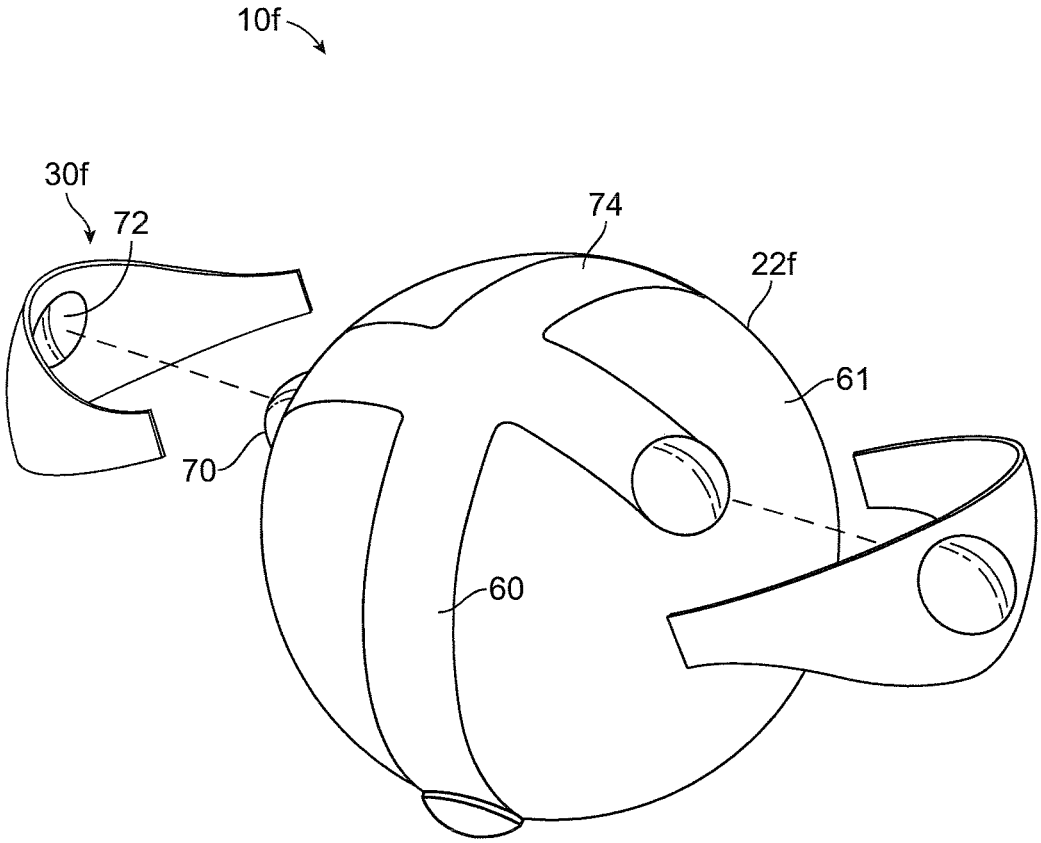
FIG. 10 is a perspective view of the sixth preferred embodiment of a ball.

FIG. 9 is an exploded view of a sixth preferred embodiment of a bouncy ball 10*f* where elements of similar structure are designated by the same reference numerals followed by the lower case "f." An outer skin shown in FIG. 10 has been removed in FIG. 9 for purposes of clarity. In FIG. 9, the ball 10*f* comprises an inner tube, or primary bladder, 22*f* which may be substantially spherical, and a secondary inflatable bladder 60. The secondary bladder 60 is configured to be coupled to an outer surface 61 of the inner tube 22*f*. Accordingly, grooves 62 are formed on the outer surface 61 of the inner tube 22*f* and configured to receive the corresponding shape of the secondary bladder 60. Thus, in the illustrated embodiment where the secondary bladder 60 comprises a cross shape and includes elongate bands 68, the inner tube 22*f* comprises corresponding cross-shaped grooves 62 to mate with and receive the secondary bladder 60.

A first inflation hole 64 is provided for inflating the inner tube 22*f* while a second inflation hole 66 is provided for inflating an air chamber of the secondary bladder 60. The secondary bladder 60 comprises a plurality of hollow inflatable anomalies 70 which, when inflated, become protrusions. In the illustrated embodiment, the hollow protrusions 70 are located at the ends of the elongate bands 68 and are in fluid communication with the air chamber.

It will be appreciated that the size, height and level of bounce of the protrusions 70 may be varied depending upon how much a user chooses to inflate the secondary bladder 60. Where a larger protrusion 70 and a greater degree of erratic bouncing is desired, the secondary bladder 60 would be inflated to a higher degree or simply the maximum.

In FIG. 10, outer skins 30*f* cover the inner tube 22*f* and the secondary bladder 50. Certain skins 30*f* are formed with pockets 72 to receive and match with the inflatable anomalies 70. Except for the protruding anomalies 70, the remaining outer surface 74 of the secondary bladder 60 is substantially flush with the outer surface 61 of the inner tube 22*f*.

If a ball is being manufactured for a particular sport and/or on behalf of a particular sports team, the anomalies in the preferred embodiments may even comprise a protruding team logo or mascot. The anomalies may also comprise protruding objects and characters which may be recognized or enjoyed by younger children such as cartoon characters, animals. The protruding anomalies may even comprise letters, numbers and symbols so as to form names and words.

Figure 11:
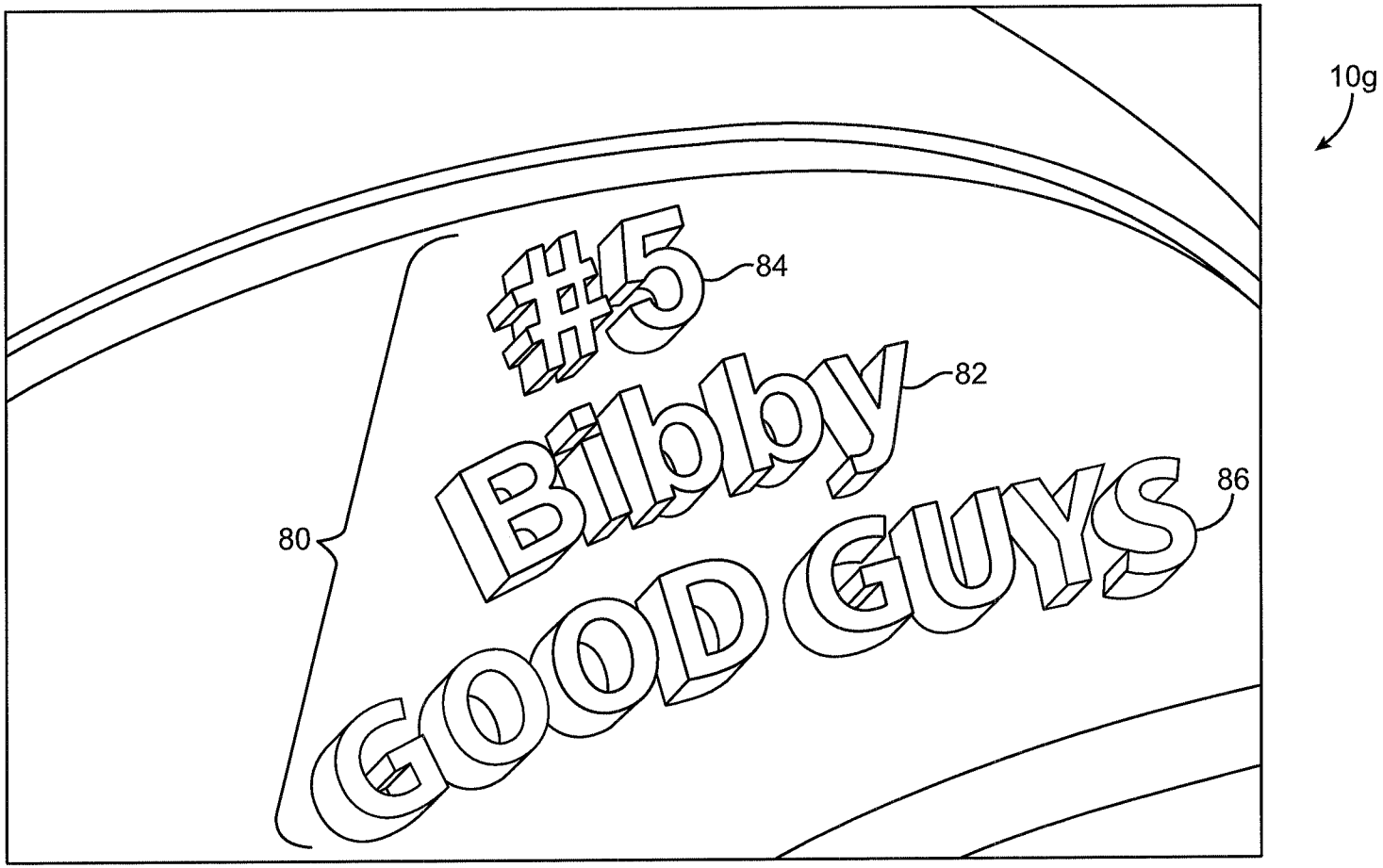
FIG. 11 is a perspective view of a seventh preferred embodiment of a ball.

For example, FIG. 11 is a perspective view of a seventh preferred embodiment 10 g which comprises protruding anomalies 80 shaped to form logos and wording. The protruding anomalies 80 in FIG. 11 may comprise a solid anomaly formed integrally with the skin as discussed in above in connection with FIGS. 1-6, or formed with a separate plug and a pocket formed in the outer skin as discussed above in connection with FIGS. 7 and 8. The anomalies 80 may also comprise inflatable anomalies formed in a secondary bladder that is coupled to an outer surface of the inner tube as discussed above in connections with FIGS. 9 and 10. If the ball being manufactured according to the preferred embodiment as shown in FIG. 11 is made for a particular sport, e.g., basketball, the ball 10*g* may comprise protruding anomalies 80 according to the invention which comprises the name 82 of a recognizable athlete or coach, e.g. "BIBBY" and his jersey number 84, as well as a team name or logo 86.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what incorporates the essential idea of the invention.

The invention claimed is:

1. A basketball configured to be dribbled by hand, comprising:

an inflatable bladder having an inner surface and an outer surface, wherein the inflatable bladder is spherical when fully inflated;

a first plurality of skins, each comprising a first material contiguous to the outer surface of the inflatable bladder and a solid anomaly, the solid anomaly formed integral with, and of the same material as, each of the first plurality of skins; and a second plurality of substantially smooth skins without anomalies, each skin in the second plurality contiguous to the outer surface of the inflatable bladder;

wherein the first plurality of skins and the second plurality of skins are configured in an alternating arrangement such that each skin in the first plurality is disposed in between a pair of skins in the second plurality, and each skin in the second plurality is disposed in between a pair of skins in the first plurality, and wherein the solid anomaly in each skin of the first plurality skins comprise different shapes.

2. The ball of claim 1, wherein the solid anomaly is at least partially spherical.

3. The ball of claim 1, wherein the solid anomaly comprises elongate grooves.

4. The ball of claim 1, wherein the solid anomaly comprises a plurality of flat surfaces formed on the outer surface of the skin.

5. A basketball configured to be dribbled by hand, comprising:

an inflatable bladder having an inner surface and an outer surface, wherein the inflatable bladder is spherical when fully inflated;

a first plurality of skins, each comprising a first rubber material contiguous to the outer surface of the inflatable bladder and a solid anomaly, the solid anomaly being integral with each of the first plurality of skins and formed from the first rubber material; and a second plurality of substantially smooth skins without anomalies and separate from the first plurality of skins, each skin in the second plurality being contiguous to the outer surface of the inflatable bladder and comprising the first rubber material, wherein the first plurality of skins and the second plurality of skins are configured in an alternating arrangement such that each skin in the first plurality is disposed in between a pair of skins in the second plurality, and each skin in the second plurality is disposed in between a pair of skins in the first plurality, and wherein the solid anomaly in each skin of the first plurality of skins comprise different shapes.

6. A basketball configured to be dribbled by hand, comprising:

an inflatable bladder having an inner surface and an outer surface, wherein the inflatable bladder is spherical when fully inflated;

a first plurality of skins, each comprising a first material contiguous to the outer surface of the inflatable bladder and a solid anomaly, the solid anomaly having sufficient size and shape to create an irregular and erratic bounce for the basketball; and a second plurality of substantially smooth skins without anomalies, each skin in the second plurality contiguous to the outer surface of the inflatable bladder;

wherein the first plurality of skins and the second plurality of skins are configured in an alternating arrangement such that each skin in the first plurality is disposed in between a pair of skins in the second plurality, and each skin in the second plurality is disposed in between a pair of skins in the first plurality, and wherein the solid anomaly in each skin of the first plurality skins comprise different shapes.

* * * * *